US007161445B2

(12) United States Patent
Yoon

(10) Patent No.: US 7,161,445 B2
(45) Date of Patent: Jan. 9, 2007

(54) PHASE SHIFTER USING TUNABLE BRAGG GRATINGS AND METHOD FOR PROVIDING A TUNABLE PHASE SHIFT FUNCTION THEREOF

(75) Inventor: Jin-Ho Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 39 days.

(21) Appl. No.: 11/059,318

(22) Filed: Feb. 17, 2005

(65) Prior Publication Data

US 2005/0179507 A1 Aug. 18, 2005

(30) Foreign Application Priority Data

Feb. 17, 2004 (KR) ..... 10-2004-0010494

(51) Int. Cl.
*H01P 1/18* (2006.01)

(52) U.S. Cl. ..... 333/161

(58) Field of Classification Search ..... 333/156, 333/161, 164

See application file for complete search history.

(56) References Cited

U.S. PATENT DOCUMENTS 5,406,233 A * 4/1995 Shih et al. ..... 333/161

6,208,222 B1 * 3/2001 Sinsky ..... 333/161

* cited by examiner

*Primary Examiner*—Benny Lee
(74) *Attorney, Agent, or Firm*—Roylance, Abrams, Berdo & Goodman, L.L.P.

(57) ABSTRACT

A phase shifter which uses Bragg gratings and having tunable phase shift functions with respect to input signals in an RF band without using a separate RF device. The phase shifter includes a dielectric layer, a first conductive layer formed on an upper surface of the dielectric layer lengthwise along the dielectric layer so as to provide a signal path for the input signal, a second conductive layer formed at a first end of a lower surface of the dielectric layer so as to form Bragg gratings lengthwise along the dielectric layer, a third conductive layer formed at a second end of the lower surface of the dielectric layer in line with the second conductive layer so as to form Bragg gratings lengthwise along the dielectric layer, and a moving unit for adjusting a distance between the second conductive layer and the third conductive layer within a predetermined length. The phase of the signal of the RF band is shifted by adjusting the distance between the second and third conductive layers without using a separate RF device, thereby significantly reducing the manufacturing cost for the phase shifter.

11 Claims, 5 Drawing Sheets

PHASE SHIFTER USING TUNABLE BRAGG GRATINGS AND METHOD FOR PROVIDING A TUNABLE PHASE SHIFT FUNCTION THEREOF

CROSS-REFERENCE TO RELATED APPLICATIONS

This application claims the benefit under 35 U.S.C. §119 (a) of Korean Patent Application No. 10-2004-0010494 entitled "Phase Shifter Using Tunable Bragg Gratings" filed with the Korean Intellectual Property Office on Feb. 17, 2004, the entire disclosure of which is hereby incorporated by reference.

BACKGROUND OF THE INVENTION

1. Field of the Invention

The present invention relates to a phase shifter used in communication equipment. More particularly, the present invention relates to a phase shifter, which uses Bragg gratings having tunable phase shift functions with respect to input signals in an RF band without using a separate RF device.

2. Description of the Related Art

In general, a phase shifter is used to control a linear phase of an amplifier that is provided at a transmitter/receiver of a mobile communication system, adjust a beam scan angle of a base station antenna, or control a phase of an output signal of a band pass filter for processing an RF signal or a duplexer using a waveguide. In cases of devices for performing a phase modulation with respect to an input signal, such as an amplifier or an antenna of a mobile communication system, a phase of an output signal must be adjusted to a desired level. To this end, the phase shifter having a phase shift function is provided to adjust the phase of the signal to the desired level. In addition, when correcting a phase error of the output signal or synchronizing signals generated from each device of the mobile communication system, the phase shift function is necessary.

The phase shifters for performing the phase shift function are classified into fixed phase shifters for outputting signals by shifting phases of input signals to fixed levels, and tunable phase shifters for shifting the phases of the input signals to desired levels. The fixed phase shifter can be embodied within a simple structure such as that provided by adjusting a length of a transmission line. However, the tunable phase shifter requires a separate phase control circuit including an RF device in order to shift the phase of the input signal to the desired level.

FIG. 1 is a circuit view illustrating a circuit structure of a conventional tunable phase shifter having a phase control circuit. Referring to FIG. 1, a hybrid coupler HC has an input terminal A connected with a signal input terminal $P_{IN}$, and an output terminal C connected with a signal output terminal $P_{OUT}$, so that a phase of an input signal $S_{IN}$ is shifted at a right angle through a signal path (A-C). Thus, a first signal, which has been phase-shifted at a right angle, is output through the signal path (A-C). In addition, the phase of the input signal $S_{IN}$ is shifted by an angle of 270 degrees through the other signal path (A-B-D-C) of the hybrid coupler HC, so that a second signal, which has been phase-shifted at an angle of 270 degrees, is output through the other signal path (A-B-D-C). Therefore, $S_{OUT}$, a combined signal of the first and second signals is output through the signal output terminal $P_{OUT}$.

The phase control circuit including varactor diodes VD1 and VD2, which are tunable resonant devices, resistors R1 and R2, and a capacitor C1, is connected between two terminals B and D of the hybrid coupler HC so as to shift the phase of the second signal passing through the other signal path (A-B-D-C) of the hybrid coupler HC. At this time, the phase of the second signal can be shifted by controlling the capacitance of the varactor diodes VD1 and VD2 by adjusting the DC bias voltage Vbias. Thus, a signal having a desired phase can be output through the signal output terminal $P_{OUT}$ of the hybrid coupler HC.

FIG. 2 is a sectional view illustrating a mechanical structure of the tunable phase shifter shown in FIG. 1. In FIGS. 1 and 2, the same reference numerals are used to refer to the same elements. In addition, since the operation of the tunable phase shifter shown in FIG. 2 has been already described with reference to FIG. 1, it will not be described in additional detail below. Although the conventional tunable phase shifter having the above structure can obtain the phase-shifted signal through the signal output terminal $P_{OUT}$ of the hybrid coupler HC by adjusting the capacitance of the varactor diodes VD1 and VD2, a plurality of components including RF devices must be provided in the conventional tunable phase shifter. Thus, the manufacturing cost for the conventional tunable phase shifter may rise.

Accordingly, a need exists for a system and method for shifting the phase of a signal in the RF band without using separate RF devices.

SUMMARY OF THE INVENTION

Accordingly, the present invention has been made to solve the above-mentioned and other problems occurring in the prior art, and an object of the present invention is to provide a phase shifter which uses Bragg gratings having tunable phase shift functions with respect to input signals in an RF band without using a separate RF device.

It is another object of the present invention to provide a method for providing a tunable phase shift function using the phase shifter.

In order to accomplish the above and other objects, a phase shifter is provided comprising a dielectric layer, a first conductive layer formed on an upper surface of the dielectric layer lengthwise along the dielectric layer so as to provide a signal path for the input signal, a second conductive layer formed at a first end of a lower surface of the dielectric layer so as to form Bragg gratings lengthwise along the dielectric layer, a third conductive layer formed at a second end of the lower surface of the dielectric layer in line with the second conductive layer so as to form Bragg gratings lengthwise along the dielectric layer, and a moving unit for adjusting a distance between the second conductive layer and the third conductive layer within a predetermined length.

In order to accomplish the above another object, a method is provided comprising the steps of providing a signal path along a first conductive layer disposed on a top surface of a dielectric layer; and shifting a phase of an input signal applied to the signal path by adjusting a distance of a third conductive layer relative to a second conductive layer within a predetermined length L, wherein the second conductive layer comprises a plurality of Bragg gratings disposed lengthwise along a bottom surface of the dielectric layer; and the third conductive layer comprises a plurality of Bragg gratings slidably disposed lengthwise along the bottom surface of the dielectric layer.

The phase of the signal of the RF band can be shifted by adjusting the distance between the second and third conductive layers without using a separate RF device, thereby significantly reducing the manufacturing cost for the phase shifter.

BRIEF DESCRIPTION OF THE DRAWINGS

The above and other objects, features and advantages of the present invention will become more apparent from the following detailed description taken in conjunction with the accompanying drawings, in which.

Throughout the drawings, like reference numerals will be understood to refer to like parts, components and structures and which may not be described in detail throughout the drawings.

DETAILED DESCRIPTION OF EXEMPLARY EMBODIMENTS

Hereinafter, exemplary embodiments of the present invention will be described with reference to the accompanying drawings. In the following description, a detailed description of functions and configurations that are well known to those skilled in the art and which are incorporated herein will be omitted for conciseness.

Figure 3:
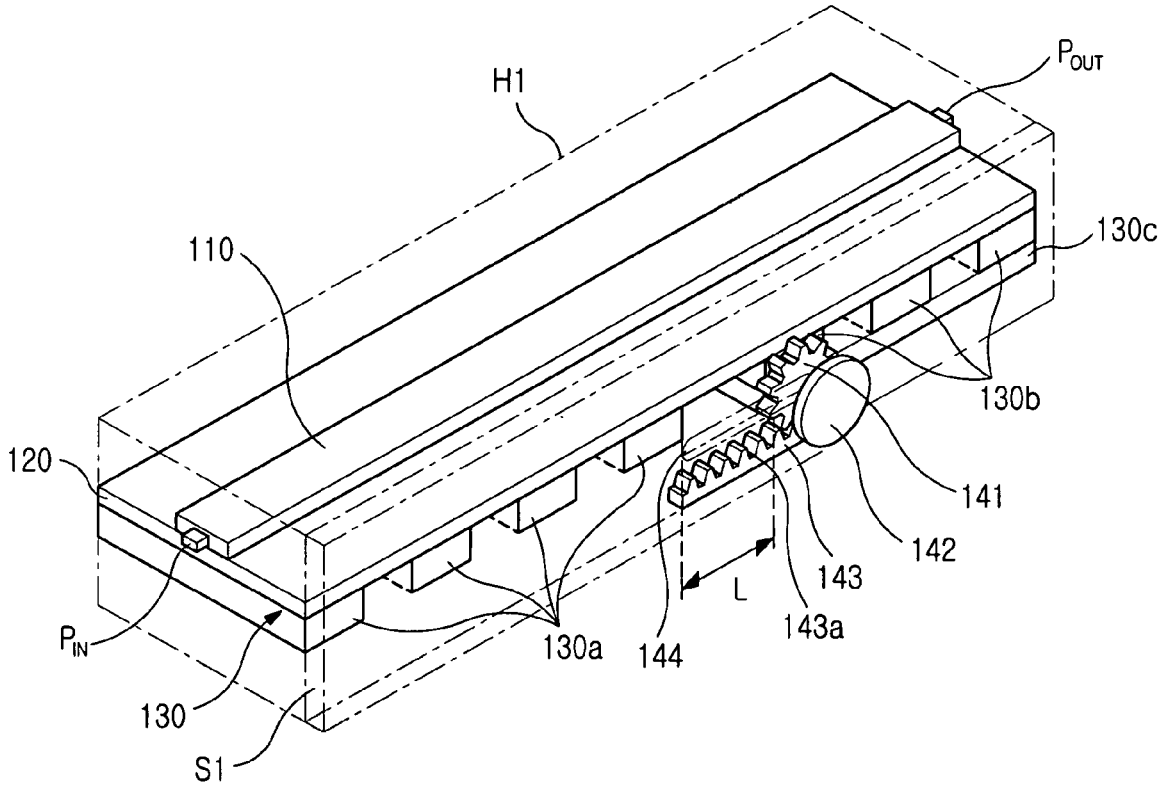
FIG. 3 is a perspective view illustrating an internal structure of a phase shifter equipped with tunable Bragg gratings and used in an RF band according to an embodiment of the present invention.
Figure 4:
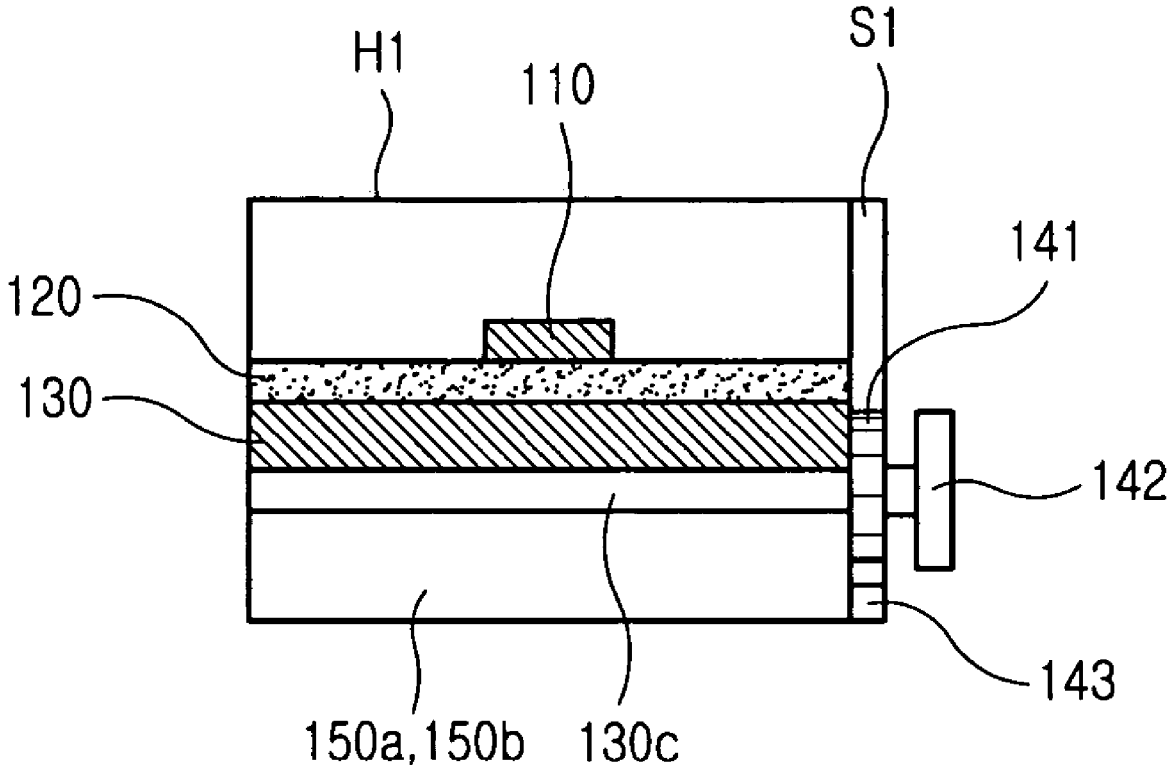
FIG. 4 is a sectional view illustrating a widthwise section of the phase shifter shown in FIG. 3.

FIG. 3 is a perspective view illustrating an internal structure of a phase shifter equipped with tunable Bragg gratings and used in an RF band according to an embodiment of the present invention, and FIG. 4 is a sectional view illustrating a widthwise section of the phase shifter shown in FIG. 3.

Bragg gratings are formed on a PCB while forming a predetermined interval therebetween. As generally known to those skilled in the art, the Bragg gratings shield a traveling wave having a predetermined wavelength, thereby shifting (delaying) a phase of an input signal. According to embodiments of the present invention, the phase shifter shifts the phase of the input signal by using the Bragg gratings while adjusting an interval between the Bragg gratings, thereby variably adjusting the phase of the input signal.

Referring to FIGS. 3 and 4, a first conductive layer 110 having a narrow width is formed on an upper surface of a dielectric layer 120 through an etching process, and a second conductive layer 130*a* (FIG. 3) forming the Bragg gratings 130 is formed on one end of a lower surface of the dielectric layer 120 also through an etching process. In addition, a third conductive layer 130*b* (FIG. 3) forming the Bragg gratings 130 is attached to the other end of the lower surface of the dielectric layer 120, thereby forming a PCB. The third conductive layer 130*b* is positioned in line with the second conductive layer 130*a* and horizontally moves within a predetermined length L (FIG. 3).

That is, the second conductive layer 130*a* is fixedly formed on the lower surface of the dielectric layer 120 through the etching process, and the third conductive layer 130*b* is movably attached to the lower surface of the dielectric layer 120. To this end, a support plate 130*c* is fixedly attached to a lower surface of the third conductive layer 130*b* so as to support the horizontal movement of the third conductive layer 130*b*, and a pinion gear 141 is installed at one side of the support plate 130*c* in such a manner that the pinion gear 141 horizontally moves along a rack gear 143 having a plurality of slots 143*a* (FIG. 3).

A handle 142 is fixed to the pinion gear 141. When a user rotates the handle 142 in a clockwise direction or a counterclockwise direction, the support plate 130*c* of the third conductive layer 130*b* fixed to the pinion gear 141 may move together with the pinion gear 141. The slots 143*a* are formed having a predetermined interval so as to engage with the pinion gear 141 moving along the rack gear 143. The interval between adjacent slots 143*a* is preferably determined by taking a desired phase adjustment angle of an input signal into consideration.

Although the exemplary embodiment of the present invention provides the pinion gear 141 and the rack gear 143 as a moving unit for the third conductive layer 130*b*, they are for illustrative purpose only. Various other moving devices can be used to horizontally move the third conductive layer 130*b* within the predetermined length L.

Referring to FIGS. 3 and 4, the PCB including first to third conductive layers 110, 130*a* and 130*b*, the dielectric layer 120, and the moving unit including the pinion gear 141 and the rack gear 143 for moving the third conductive layer 130*b*, are each installed at an inner portion of a housing H1. The housing H1 is formed with an inner portion thereof, and a cavity SI for receiving the moving unit and which is formed at one side thereof with a guide slot 144 (FIG. 3) so as to guide the moving direction of the handle 142 fixed to the pinion gear 141.

Figure 5:
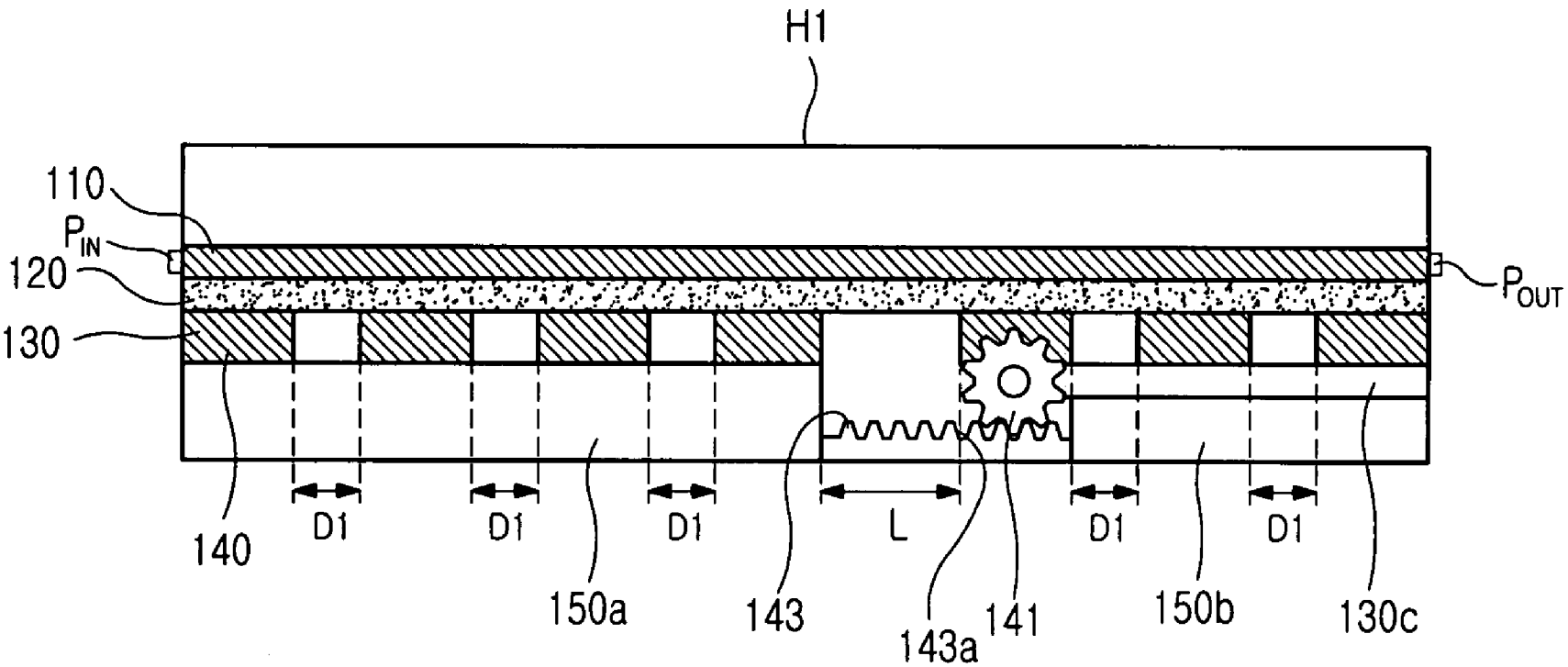
FIG. 5 is a sectional view illustrating a lengthwise section of the phase shifter shown in FIG. 3.

Although not illustrated in FIG. 3, the phase shifter further includes supporters 150*a* and 150*b* which are installed at lower portions of the second and third conductive layers 130*a* and 130*b*, respectively, as shown in FIGS. 4 and 5, in order to stably support the PCB installed in the housing H1.

A conductive material or member (not shown) is coated or attached onto the inner portion of the housing H1 in order to provide a common ground for the second and third conductive layers 130*a* and 130*b*. The first conductive layer 110 is used as a signal path. That is, a signal input terminal $P_{IN}$ is connected to one end of the first conductive layer 110, and a signal output terminal $P_{OUT}$ is connected to the other end of the first conductive layer 110, thereby forming the signal path as depicted in FIG. 3. A phase of an input signal applied to the signal input terminal $P_{IN}$ is shifted by means of the Bragg gratings 130 defined by the second and third conductive layers 130*a* and 130*b*. The level of the signal phase shift by means of the Bragg gratings 130 can be controlled by adjusting the movement of the third conductive layer 130*b* within the predetermined length L.

FIG. 5 is a sectional view illustrating a lengthwise section of the phase shifter shown in FIG. 3.

Hereinafter, an operation of the phase shifter according to an embodiment of the present invention will be described with reference to FIG. 5.

A first distance D1 is uniformly formed between Bragg gratings 130 defined by the second and third conductive layers 130*a* and 130*b*. Preferably, the first distance D1 is defined by the following Equation (1), $$\frac{\lambda}{4} \quad (1)$$

wherein λ is a wavelength of the input signal. In addition, a second distance L provided between the second conductive layer 130*a* and the third conductive layer 130*b* is preferably within a range defined by the following Equation (2).

$$0 < L < \frac{\lambda}{2} \quad (2)$$

According to experiments performed with embodiments of the present invention, when the pinion gear 141 moves to the left along the rack gear 143 in such a manner that the third conductive layer 130*b* makes contact with the second conductive layer 130*a*, the second distance L is approximately 0, and the phase of the input signal is shifted about +40 degrees. In addition, when the pinion gear 141 moves to the right along the rack gear 143 in such a manner that the second and third conductive layers 130*a* and 130*b* can be aligned and separated by some distance as shown in FIG. 5, the second distance L is approximately, $$\frac{\lambda}{2}$$

and the phase of the input signal is shifted about −50 degrees.

Therefore, when using the phase shifter having the above structures, the phase of the input signal can be shifted within a range of about 90 degrees by simply adjusting the mechanical structure without using the separate phase control circuit including the RF devices. In addition, the level of the phase shift can be controlled by adjusting the number of slots 143*a* engaged with the pinion gear 141.

Although the present invention has been described in regards to an exemplary embodiment that shifts the phase of the signal within the range of 90 degrees by setting the first distance D1 to, $$\frac{\lambda}{4}$$

and the second distance L to, $$0 < L < \frac{\lambda}{2}$$

the phase shift range can be increased or reduced by adjusting the first and second distances D1 and L.

Figure 1:
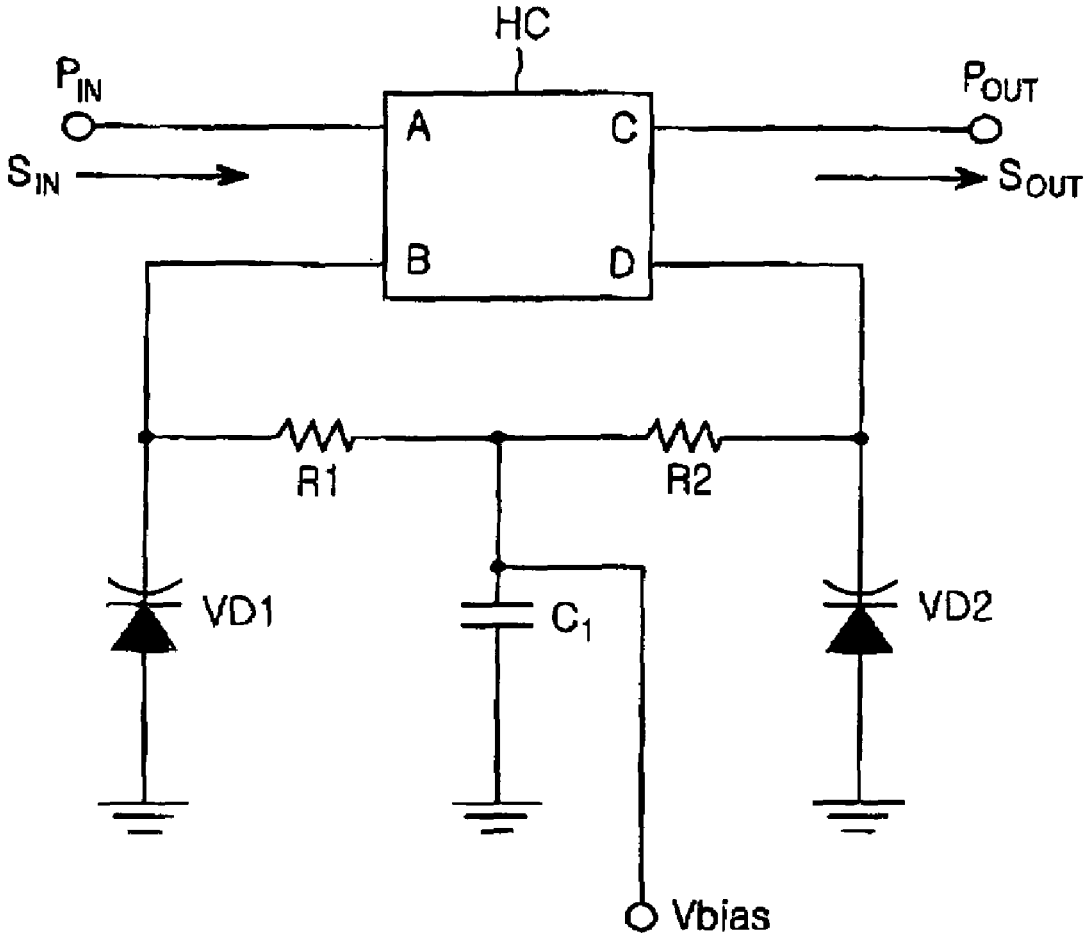
FIG.1 (PRIOR ART)
FIG. 1 is a schematic illustrating a circuit structure of a conventional tunable phase shifter having a phase control circuit.
Figure 2:
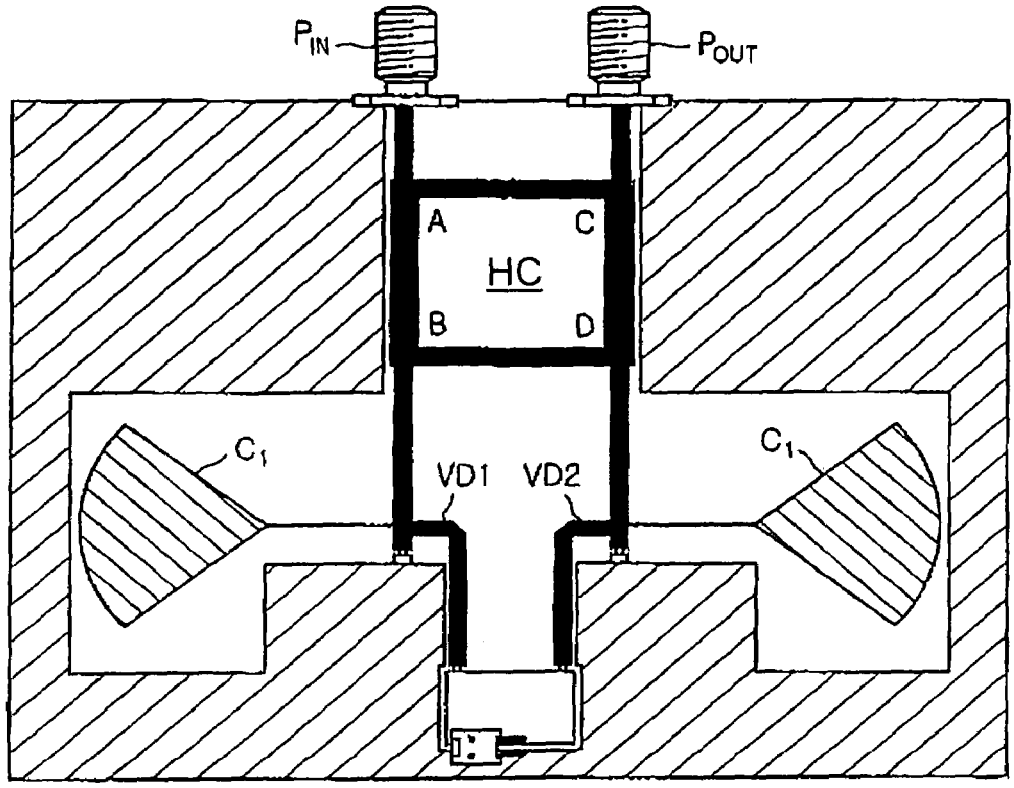
FIG.2 (PRIOR ART)
FIG. 2 is a sectional view illustrating a mechanical structure of a conventional tunable phase shifter shown in FIG. 1.

In addition, similar to the conventional tunable phase shifter shown in FIG. 1, the tunable phase shifter having the above structures can be used to control the linear phase of the amplifier of the mobile communication system, adjust the beam scan angle of the base station antenna, or control the phase of the signal of a duplexer using a band pass filter for processing an RF signal or the waveguide.

As described above, according to the present invention, the Bragg gratings are formed at the lower surface of the PCB through an etching process such that the interval between the Bragg gratings can be adjusted, so that the tunable phase shifter having the Bragg gratings can shift the phase of the signal in the RF band without using separate RF devices. Thus, the manufacturing cost for the tunable phase shifter can be significantly reduced.

While the invention has been shown and described with reference to certain exemplary embodiments thereof, it will be understood by those skilled in the art that various changes in form and detail may be made therein without departing from the spirit and scope of the invention as defined by the appended claims.

What is claimed is:

1. A phase shifter for shifting a phase of an input signal in an RF band, the phase shifter comprising:

a dielectric layer;

a first conductive layer disposed lengthwise along an upper surface of the dielectric layer so as to provide a signal path for the input signal;

a second conductive layer disposed at a first end of a lower surface of the dielectric layer so as to provide Bragg gratings lengthwise along the dielectric layer;

a third conductive layer disposed at a second end of the lower surface of the dielectric layer in line with the second conductive layer so as to provide Bragg gratings lengthwise along the dielectric layer; and a moving unit, operatively associated with one of the second and third conductive layers, for adjusting a distance (L) between the second conductive layer and the third conductive layer.

2. The phase shifter as claimed in claim 1, wherein an interval between the Bragg gratings is defined by a distance, $$\frac{\lambda}{4}$$

wherein λ is a wavelength of the input signal.

3. The phase shifter as claimed in claim 1, wherein the distance (L) between the second conductive layer and the third conductive layer is within a range defined by, $$0 < L < \frac{\lambda}{2}$$

wherein λ is a wavelength of the input signal.

4. The phase shifter as claimed in claim 1, wherein the first and second conductive layers are conductive plates fixed to upper and lower surfaces of the dielectric layer, respectively.

5. The phase shifter as claimed in claim 1, wherein the first and second conductive layers comprise etched conductive plates fixed to upper and lower surfaces of the dielectric layer, respectively.

6. The phase shifter as claimed in claim 1, wherein the third conductive layer comprises an etched conductive plate moveably attached to a lower surface of the dielectric layer.

7. The phase shifter as claimed in claim 1, wherein:

the first and second conductive layers are fixed to the dielectric layer; and the third conductive layer is movably attached to the dielectric layer such that the third conductive layer can be horizontally moved by means of the moving unit.

8. The phase shifter as claimed in claim 1, wherein the moving unit comprises:

a pinion gear connected to the third conductive layer through a support member; and a rack gear having a plurality of slots engaged with the pinion gear.

9. The phase shifter as claimed in claim 8, wherein a number of the plurality of slots is determined based upon a desired range for an angle of a shifted phase.

10. A method for providing a tunable phase shift function with respect to input signals, comprising the steps of:

providing a signal path along a first conductive layer disposed on a top surface of a dielectric layer;

providing a second conductive layer and a third conductive layer on a bottom surface of the dielectric layer; and shifting a phase of an input signal applied to the signal path by adjusting a distance of the third conductive layer relative to the second conductive layer within a predetermined length L, wherein, the second conductive layer comprises a plurality of Bragg gratings disposed lengthwise along a bottom surface of the dielectric layer; and the third conductive layer comprises a plurality of Bragg gratings slidably disposed lengthwise along the bottom surface of the dielectric layer.

11. The method as claimed in claim 10 further comprising the step of:

adjusting the distance (L) between the second conductive layer and the third conductive layer using a moving unit.

* * * * *